United States Patent [19]

Billings et al.

[11] 4,187,128

[45] Feb. 5, 1980

[54] MAGNETIC DEVICES INCLUDING AMORPHOUS ALLOYS

[75] Inventors: Robert L. Billings, Andover, Mass.; Ho-Sou Chen, Warren; Ernst M. Gyorgy, Madison; Richard C. Sherwood, New Providence, all of N.J.

[73] Assignee: Bell Telephone Laboratories, Incorporated, Murray Hill, N.J.

[21] Appl. No.: 945,914

[22] Filed: Sep. 26, 1978

[51] Int. Cl.[2] ..... H01F 1/00

[52] U.S. Cl. ..... 148/121; 148/101; 148/31.55

[58] Field of Search ..... 148/121, 31.55, 31.57, 148/100, 101

[56] References Cited

U.S. PATENT DOCUMENTS

| | | | |
|---|---|---|---|
| 3,732,349 | 5/1973 | Chen et al. | 264/175 |
| 3,838,365 | 9/1974 | Dutoit | 330/30 R |
| 4,053,333 | 10/1977 | Egami et al. | 148/120 |
| 4,056,411 | 11/1977 | Chen et al. | 148/121 |

OTHER PUBLICATIONS

*The Review of Scientific Instruments*, 41, No. 8, Aug. 1970, p. 1237.

*Amorphous Magnetism* 1973, Plenum Press, New York, pp. 313–320.

Materials Research Bulletin, 11 (1976), pp. 49–54, Permagon Press Inc. Chen et al. Bell Lab. Murray Hill, N. J.

Journal of NonCrystalline Solids 15 (1974), pp. 165–173 and 15 (1974), pp. 174–178.

*Primary Examiner*—L. Dewayne Rutledge

*Assistant Examiner*—John P. Sheehan

*Attorney, Agent, or Firm*—Allen N. Friedman; Peter A. Businger

[57] ABSTRACT

The disclosed magnetic devices, including a magnetically coupled conducting path, incorporate amorphous, low magnetostriction alloys of the general formula $(Co_aFe_bT_c)_iX_j$, the "metallic" constituents thereof being within the parenthetical expression. T, in the formulation, is selected from among Ni, Cr, Mn, V, Ti, Mo, W, Nb, Zr, Pd, Pt, Cu, Ag and Au, X being at least one "glass former" selected from among P, Si, B, C, As, Ge, Al, Ga, In, Sb, Bi and Sn. The "metallic" constituents comprise from 70–90 atomic percent of the alloy with cobalt being present in an amount of at least 70 atomic percent of the "metallic" constituents. The described material has been prepared by rapid cooling from the liquid, directly to the shape needed for fabrication of the device (e.g., tape to be wound to form an inductor core). When the amorphous material is heat treated for from 30 minutes to two hours at temperatures from 125 degrees Centigrade to 200 degrees Centigrade, it exhibits a temperature stabilized magnetic permeability. The fabrication of such devices as temperature stabilized inductors and transformers is contemplated.

6 Claims, 4 Drawing Figures

MAGNETIC DEVICES INCLUDING AMORPHOUS ALLOYS

BACKGROUND OF THE INVENTION

1. Field of the Invention

The invention is in the field of electromagnetic devices using soft magnetic materials.

2. Brief Description of the Prior Art

Many metallic alloys have been produced in amorphous (non-crystalline) form by such methods as rapid cooling from the melt. These amorphous alloys have markedly different magnetic and mechanical properties from crystalline alloys of similar composition. Among these amorphous alloys are various nickel containing, iron containing and cobalt containing alloys, which include glass formers such as phosphorous and boron. (See, for example, *Journal of Non-Crystalline Solids,* 15 (1974) 165–173; *Amorphous Magnetism,* edited by H. O. Hooper and A. M. de Graaf, 1973, Plenum Press, New York, pp. 313–320; U.S. Pat. No. 3,838,365, Sept. 24, 1974 issued to M. Dutoit.) Various workers have studied the mechanical, electrical, magnetic, and acoustic properties of such amorphous materials. The characterization of these materials as amorphous is borne out by X-ray scattering measurements which do not show the sharp scattering peaks characteristic of crystalline materials. This characterization is particularly appropriate when considering the magnetic properties of these materials since the X-ray characteristic length is much smaller than distances characteristic of magnetic ordering phenomena. These materials have also been found to possess many of the thermodynamic properties of glasses. Many investigators are currently searching to find amorphous alloys with useful properties. The fabrication of amorphous alloy articles of high magnetic permeability is disclosed in U.S. Pat. No. 4,056,411, issued Nov. 1, 1977 (Chen-Gyorgy-Leamy-Sherwood).

SUMMARY OF THE INVENTION

It has been found that certain cobalt rich amorphous alloys possess low magnetostriction along with high electrical resistance and excellent soft magnetic properties. These materials are produced directly in a form needed for the fabrication of many classes of magnetic devices so that it is not necessary to go through the many metallurgical processing steps needed to reduce ingots to the form required for these devices. These materials have been produced in the form of a thin tape or sheet directly from a melt. Such amorphous alloys are also produced by vapor phase processes as sputtering onto a cooled substrate. The invention of this disclosure involves the achievement of magnetic materials with a temperature region of relatively stable magnetic permeability, through the use of a novel heat treatment applied to these low magnetostriction materials. It has been found that heat treatment from 30 minutes to two hours at temperatures from 125 degrees centigrade to 200 degrees centrigrade produces a marked improvement in the temperature stability of the magnetic permeability of these materials.

The subject materials are cobalt rich, cobalt-iron based alloys including a total of from 10 to 30 atomic percent of "glass formers", the glass forming group consisting of P, Si, B, C, As, Ge, Al, Ga, In, Sb, Bi and Sn. The cobalt-iron "metallic" portion can also include up to approximately 25 percent of a species selected from Ni, Cr, Mn, V, Ti, Mo, W, Nb, Zr, Pd, Pt, Cu, Ag, Au. For each value of the total proportion of "metallic" constituents there is a narrow band of compositions which defines the range of low magnetostriction compositions. This band may vary as the amount of "metallic" constituent varies with respect to the amount of glass forming constituent.

DETAILED DESCRIPTION OF THE INVENTION

The Materials

A class of low magnetostrictive amorphous alloys of excellent soft magnetic properties has been found within the composition range represented by $(Co_aFe_bT_c)_iX_j$; with $0.7 \leqq a \leqq 0.97$, $0.03 \leqq b \leqq 0.25$ and $a+b+c=1$. The elements within the parenthesis can be called the "metallic" constituents which make up from 70 to 90 atomic percent of the alloy ($0.7 \leqq i \leqq 0.9$) and X is the "glass former" group, which make up the remainder. X is selected from P, Si, B, C, As, Ge, Al, Ga, In, Sb, Bi and Sn or a combination of these. T is selected from Ni, Cr, Mn, V, Ti, Mo, V, W, Nb, Zr, Pd, Pt, Cu, Ag, and Au or a combination of these. The subscripts i and j sum to 1. The limits on the content of "metallic" constituents approximately delimit the composition range within which low magnetostriction is obtainable. From 10 to 30 atomic percent of glass formers is needed to achieve sufficiently stable amorphous alloys.

The above materials can be produced in amorphous form, for example, by extremely rapid cooling from the melt, usually as thin foils or tapes. Glass formers specified above are known to be so operative in nickel-iron alloys (*Journal of Non-Crystalline Solids,* 15 (1974) 165–173). It has been found that similar proportions are effective as glass formers in the alloys considered here. Improved stability results from inclusion of at least one atomic percent of at least one element selected from P, Si, B, C, As and Ge together with at least one atomic percent of at least one element selected from Al, Ga, In, Sb, Bi and Sn.

Figure 1:
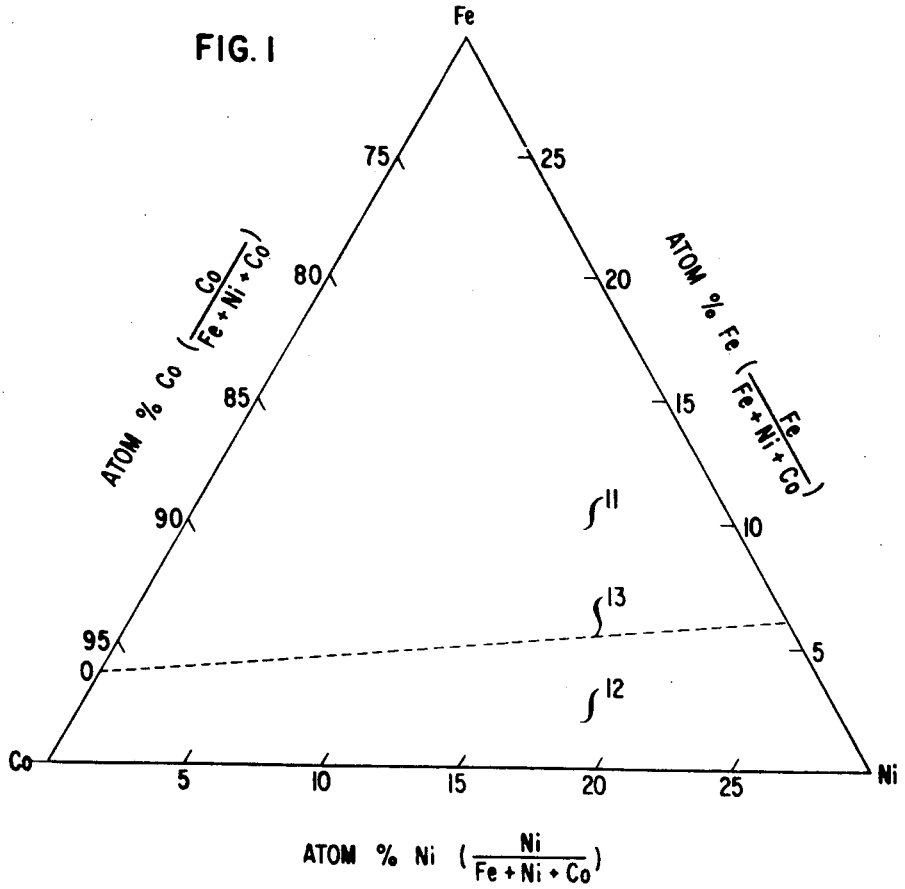
FIG. 1 is a ternary composition diagram showing the cobalt, iron, and nickel composition range within which exemplary low magnetostriction amorphous alloys fall.

FIG. 1 shows the composition range of magnetic constituents within which exemplary nickel containing low magnetostrictive amorphous alloys lie. The magnetostriction is observed to be positive in the upper portion 11 of this range and negative in the lower portion 12. The dashed line 13 indicates the approximate position of optimum low magnetostrictive amorphous alloys for nickel containing alloys with approximately 25 atomic percent of glass forming constituents and 75 atomic percent "metallic" constituents. Within plus or minus one-half atomic percent in iron composition, the magnetostrictive effect is less than 10 percent of the magnetostrictive effect observed well away from the line. Variation of cobalt or nickel composition is at constant iron content somewhat less restricted since the change produced is nearly parallel to the line 13. For a composition made with an iron content within 0.1 atomic percent of the line, no magnetostrictive effect was observed on the same apparatus as was used to make the other measurements. This line 13 approximately describes the position of low magnetostriction for alloys "metallic" material content within plus or minus 5 atomic percent of the above-mentioned 75 atomic percent quantity. The location of this line 13 was determined by experimental data reported in Table 1. The alloys measured can be represented by the approximate formula $(Co_aFe_bNi_c)_{0.75}P_{0.16}B_{0.06}Al_{0.03}$.

is temperature stability of the magnetic permeability. Amorphous magnetic material in the above-described composition range has been produced possessing relatively high permeability with a usefully wide temperature range of stability of permeability in the neighborhood of room temperatures. The achievement of low coercivity is usually related to the achievement of a material possessing low magnetostriction. In addition, low magnetostriction is desirable for the production of devices whose properties are insensitive to mechanical stress during fabrication and varying thermomechanical

TABLE I

| SAMPLE | COMPOSITION | GLASS TRANSITION OR CRYSTALLIZATION TEMPERATURE | CHANGE OF MAGNETIZATION FOR GIVEN STRESS | AMORPHOUS TO X-RAY | CURIE TEMPERATURE |
|---|---|---|---|---|---|
| 1 | $(Co_{.9}Fe_{0.1})_{.75}P_{.16}B_{.06}Al_{.03}$ | ≅760° K. | +15% | yes | 657° K. |
| 2 | $(Co_{.95}Fe_{.05})_{.75}P_{.16}B_{.06}Al_{.03}$ | ≅756° K. | +7% | yes | 642° K. |
| 3 | $(Co_{.96}Fe_{.04})_{.75}P_{.16}B_{.06}Al_{.03}$ | ≅757° K. | 0 | yes | 640° K. |
| 4 | $(Co_{.98}Fe_{.02})_{.75}P_{.16}B_{.06}Al_{.03}$ | ≅759° K. | −18.5% | yes | 633° K. |
| 5 | $Co_{.75}P_{.16}B_{.06}Al_{.03}$ | ≅763° K. | −35% | yes | 630° K. |
| 6 | $(Co_{.72}Fe_{.08}Ni_{.2})_{.75}P_{.16}B_{.06}Al_{.03}$ | ≅743° K. | +8% | yes | 565° K. |
| 7 | $(Co_{.76}Fe_{.04}Ni_{.2})_{.75}P_{.16}B_{.06}Al_{.03}$ | ≅743° K. | −29% | yes | 560° K. |

Production of Amorphous Alloys

Amorphous alloys have been produced by several methods involving rapid cooling of thin sections of the molten material. Some techniques involve the injection of a thin stream of liquid into a cooling bath, others involve contact of a thin portion of liquid with a cool solid. The latter techniques have been characterized under the general description of "splat cooling." Among these techniques are the piston and anvil technique and techniques involving the dropping of a portion of liquid between two counterrotating rollers (H. S. Chen and C. E. Miller, *The Review of Scientific Instruments,* 41, No. 8 (August 1970) 1237) or the injection of a thin stream of liquid between counterrotating rollers, such as in the apparatus pictured in U.S. Pat. No. 3,732,349 issued May 8, 1973 to Ho-Sou Chen et al. Amorphous metals have also been produced by vapor deposition or electrolytic deposition on a cooled surface (see, for example, *Journal of Applied Physics,* 49 [1978] 1703).

In materials produced by the techniques described above, the extent or absence of crystalline ordering is investigated by such techniques as X-ray and electron beam scattering. These techniques, applied to the materials under consideration here, have shown no significant crystalline ordering over a greeater than approximately 20 Angstroms range. Since magnetic ordering takes place with a characteristic length of the order of 1000 Angstroms, these materials show no crystalline ordering which can be seen by the magnetic system and, thus, can be classified as amorphous for purposes of magnetic description.

Material Properties

Figure 2:
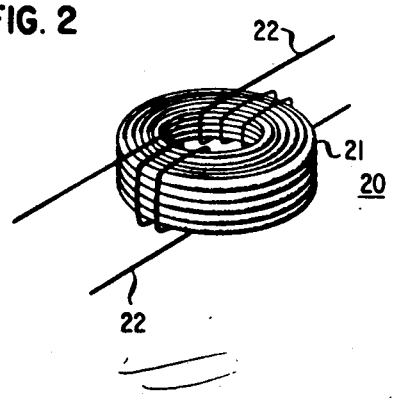
FIG. 2 is a perspective view of an exemplary electromagnetic device.

Soft magnetic materials with high electrical resistivity are required for the production of electromagnetic devices, such as inductors or transformers as pictured in FIG. 2. In FIG. 2 a transformer consists of a magnetic core 20 and conducting windings 22. The core 20 is wound from a long thin wire or tape 21 of an amorphous magnetic alloy. Similar devices produced in miniaturized form by evaporative techniques, such as sputtering, could be used for compact circuitry.

Properties of importance in such devices include high initial permeability, high remanence and low coercivity. One property which is particularly difficult to achieve stress during use. These materials have resistivities of the order of 200 μohm centimeters, which is an order of magnitude higher than the resistivities of permalloy materials.

The achievement of materials whose initial permeability varies within a restricted range over the temperature range of device interest is of importance for many electronic circuit uses. For example, temperature stable inductors can be used to produce temperature stable resonant circuits and filter networks. A novel heat treatment has been found which produces this desirable characteristic in the low magnetostriction amorphous alloys described above. This heat treatment is at temperatures from 125 degrees Centigrade to 200 degrees Centigrade for times from 30 minutes to two hours. Such heat treatments are designed to produce a variation of magnetic permeability (initial permeability) of less than a total span of five percent over a temperature interval of at least 60 Centigrade degrees centered at approximately 20 degrees Centigrade. The temperature and time heat treatment schedule can be optimized for over somewhat different operating temperature ranges. However, at heat treatment temperatures below 125 degrees Centigrade and treatment times less than 30 minutes the improvement realized is not significant for many uses. At heat treatment temperatures above 200 degrees Centigrade and treatment times more than two hours the improvement of the variation of magnetic permeability with operating temperature becomes less significant.

The required residence time at the heat treatment temperature is somewhat temperature dependent, since the probable physical phenomenon is diffusion related. Higher temperatures generally require shorter times. The heat treatment is performed either before or after the filament is wound to the desired shape or placed in its device situation adjacent to an electrically conductive path. Indeed, the use of the filament in planar form or in the form of a deposited (e.g., sputter deposited) element on a substrate, is also contemplated. In the preferred examples the winding was done first.

EXAMPLES

The samples reported in Table I were produced by injecting a stream of molten metal of the desired composition into the contact area of two counterrotating cool rollers, from a fused silica tube with a 200 micrometer diameter opening. The liquid was forced from the tube by imposing a $\sim\frac{1}{2}$ atmosphere overpressure of Ar gas on the upper surface of the liquid. The apparatus was similar to the apparatus pictured in U.S. Pat. No. 3,732,349 issued May 8, 1973 to Ho-Sou Chen et al. The rollers were 5 cm in diameter and rotating at a rate of 1000 revolutions per minute. The amorphous alloy was produced in the form of a tape 3 millimeters wide and approximately of 50 micrometers thick.

Metallic glass tapes approximately 25 μm thick were produced by a spinning apparatus as described in Ho-Sou Chen et al, *Materials Research Bulletin,* 11 (1976) 49 from an exemplary molten composition. Measurements of the properties of these tapes are shown in FIGS. 3 and 4.

Figure 3:
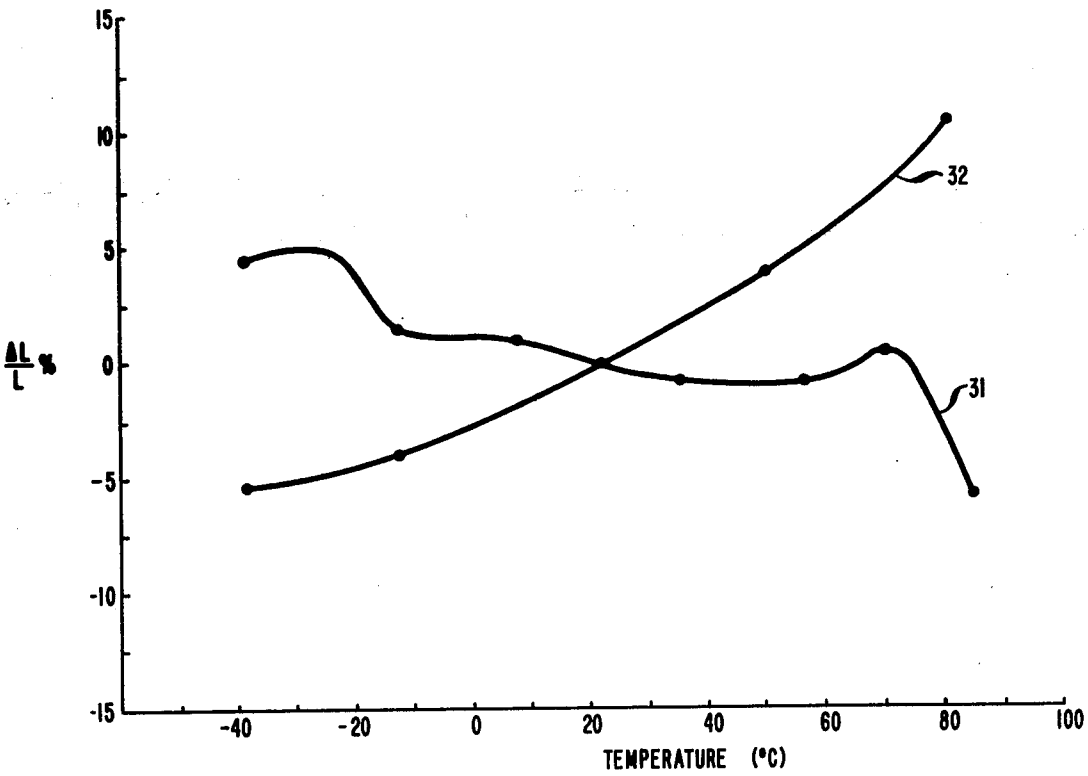
FIG. 3 is a graph of inductance variation with operating temperature comparing a device of the invention with a prior art device.

FIG. 3 shows that in the exemplary alloy $(Co_{0.96}Fe_{0.04})_{0.75}P_{0.16}B_{0.06}Al_{0.03}$ (Sample 3 of Table I) a heat treatment at 150 degrees Centigrade for one hour produces a material which varies in initial permeability by less than a total span of 2.5% over a temperature range from −10 degrees Centigrade to 75 degrees Centigrade (FIG. 3, curve 31). This compares to a total variation of approximately 25% for the unheat-treated sample (FIG. 3, curve 32). The experimental results plotted in FIG. 3 appear in terms of inductance variation. This is directly related to initial magnetic permeability.

Figure 4:
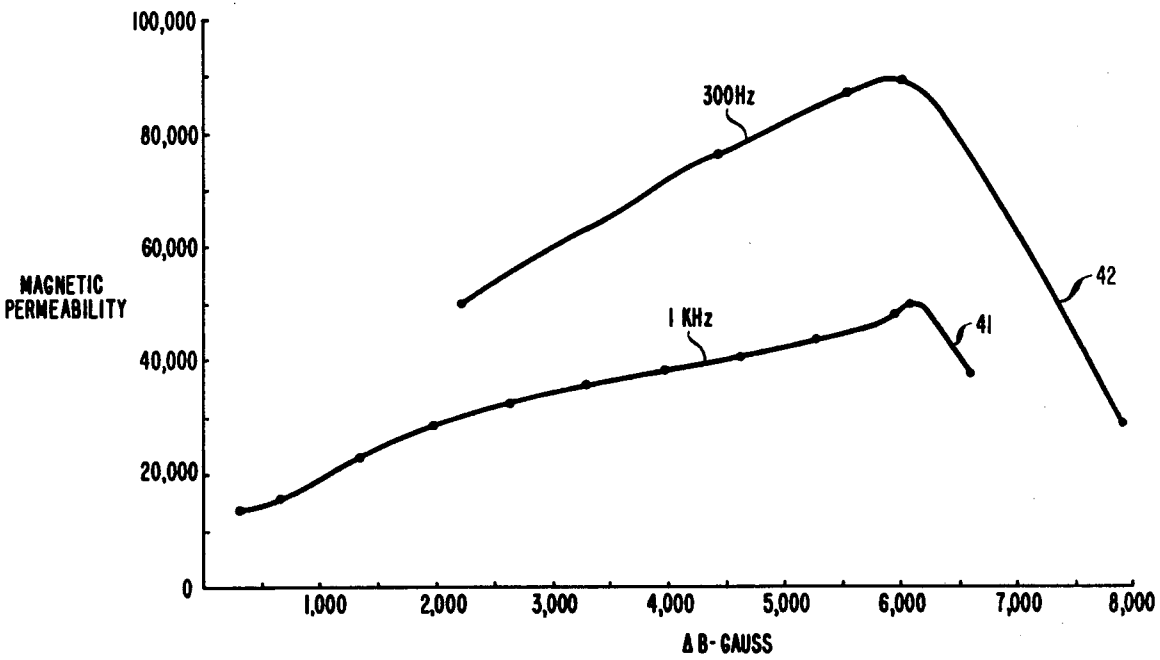
FIG. 4 is a graph of magnetic permeability as a function of operating temperature for the material of FIG. 3.

FIG. 4 shows magnetic permeability (initial permeability) as a function of drive field at 300 Hz and 1 kHz as curves 41 and 42.

We claim:

1. Method for the production of a device, said method consisting of:

a. forming a magnetic body consisting essentially of an amorphous low magnetostrictive metallic alloy by cooling said alloy from a melt or by depositing said alloy on a substrate, the composition of said alloy being represented by the formula $(Co_aFe_bT_c)_iX_j$ wherein i. T is at least one first species selected from the group consisting of Ni, Cr, Mn, V, Ti, Mo, W, Nb, Zr, Pd, Pt, Cu, Ag, Au;

ii. X is at least one second species selected from the group consisting of a first subgroup, consisting of P, Si, B, C, As and Ge and a second subgroup consisting of Al, Ga, In, Sb, Bi and Sn;

iii. i is from 0.7 to 0.9;

iv. $i+j=1$;

v. a is from 0.7 to 0.97; and vi. b is from 0.03 to 0.25 with $a+b+c=1$, b. placing the body adjacent to an electrically conductive path, and c. a characterizing additional step which is carried out either before or after placing said body adjacent to said electrically conductive path, said additional step consisting of heat treating the body by heating at heat treatment temperatures from 125 degrees Centigrade to 200 degrees Centigrade for heat treatment times from 30 minutes to two hours, which heat treatment is selected to yield a body with a temperature stabilized magnetic permeability.

2. Method of claim 1 in which the body exhibits a magnetic permeability variation of less than a total span of five percent over a temperature interval of at least 60 Centigrade degrees centered at approximately 20 degrees Centigrade.

3. Method of claim 2 in which the magnetic alloy can be approximately represented by the formula $(Co_{0.96}Fe_{0.04})_{0.75}P_{0.16}B_{0.06}Al_{0.03}$ and in which heat treatment temperatures are approximately 150 degrees C.

4. Method of claim 1 in which the magnetic body is formed by winding a filament of the alloy.

5. Method of claim 4 in which the body is placed adjacent to the electrically conductive path prior to the heat treatment.

6. A device made by the method of claim 1.

* * * * *